United States Patent [19]

Le Boucher et al.

[11] Patent Number: 4,489,137

[45] Date of Patent: Dec. 18, 1984

[54] PROCESS FOR INCREASING THE RESISTANCE TO CRACKING CORROSION OF ELONGATE ELEMENTS SUCH AS ARMORINGS OF FLEXIBLE PIPES OR CABLES AND THE RESULTANT PRODUCTS

[75] Inventors: Bernard Le Boucher, Versailles; André Sugier, Rueil-Malmaison, both of France

[73] Assignee: Institut Francais du Petrole, Rueil-Malmaison, France

[21] Appl. No.: 515,244

[22] Filed: Jul. 19, 1983

[30] Foreign Application Priority Data

Jul. 19, 1982 [FR] France ..... 82 12697

[51] Int. Cl.[3] ..... B21F 1/00

[52] U.S. Cl. ..... 428/610; 72/160; 148/39

[58] Field of Search ..... 72/160–165; 140/147; 428/610; 148/39

[56] References Cited

U.S. PATENT DOCUMENTS

| | | | |
|---|---|---|---|
| 3,777,532 | 12/1973 | Noé | 72/160 |
| 3,929,523 | 12/1975 | Kinoshi et al. | 148/39 |
| 3,992,231 | 11/1976 | Timmons | 148/39 |
| 4,067,215 | 1/1978 | Nakajima et al. | 72/160 |
| 4,108,695 | 8/1978 | Paulitsch et al. | 148/39 |
| 4,146,411 | 3/1979 | Dewsnap et al. | 148/39 |

FOREIGN PATENT DOCUMENTS

| | | | |
|---|---|---|---|
| 40568 | 11/1981 | European Pat. Off. | 72/160 |
| 2103892 | 8/1972 | Fed. Rep. of Germany | 72/160 |
| 2830890 | 9/1979 | Fed. Rep. of Germany | 72/160 |
| 1206286 | 9/1970 | United Kingdom | 140/147 |
| 197492 | 8/1967 | U.S.S.R. | 140/147 |
| 237795 | 7/1969 | U.S.S.R. | 140/147 |

*Primary Examiner*—L. Dewayne Rutledge
*Assistant Examiner*—J. J. Zimmerman
*Attorney, Agent, or Firm*—Millen & White

[57] ABSTRACT

The resistance to cracking corrosion of steel elongate elements, such as wires or armorings of flexible pipes or cables destined to be exposed to the corrosion of aqueous corrosive media, is increased by subjecting said elements to a series of alternate flexions in opposite directions, by passing them between rollers in staggered arrangement, so as to generate in said elements compression zones extending from each of the main external surfaces thereof to the inside over at least one third of the distance of said surface to the longitudinal axis of the element.

20 Claims, 7 Drawing Figures

PROCESS FOR INCREASING THE RESISTANCE TO CRACKING CORROSION OF ELONGATE ELEMENTS SUCH AS ARMORINGS OF FLEXIBLE PIPES OR CABLES AND THE RESULTANT PRODUCTS

BACKGROUND OF THE INVENTION

The present invention concerns a process for increasing the resistance to cracking corrosion of elongate elements, particularly elongate metal elements formed by cold drawing, as well as the products obtained by this process.

It is known that certain metals are sensitive to cracking corrosion when exposed to certain aqueous corrosive media, and particularly when exposed to aqueous media containing hydrogen sulfide, so that when they are simultaneously subjected to tensile stresses their sensitivity to cracking corrosion becomes greater as these stresses become higher.

In particular, this type of corrosion occurs with cold-drawn carbon steels whose hardness after drawing exceeds the value of 22 Rockwell C, which is the case of the steels of high carbon content.

On the contrary, the steels whose hardness is lower than the above-mentioned limit value are not sensitive to cracking corrosion in aqueous medium containing hydrogen sulfide.

A typical composition of steels likely to undergo this type of corrosion is, for example,: C=0.84%; Mn=0.575%; Si=0.174%; S=0.008%; P=0.017%.

Such steels undergo a hardening treatment called "patenting" and are then drawn and cold-shaped.

An example of the mechanical characteristics thus obtained is as follows: resistance to traction: 1360 MPa, elastic limit at 0.2%; 1.280 MPa.

An important but non exclusive application of this invention consists in the protection against cracking corrosion of elongate metal elements destined to be helically wound to form armourings of flexible pipes or cables.

By experiment it has been ascertained, as a matter of fact, that in certain conditions of use, particularly in contact with agressive media such as sea water, the armourings may be damaged by the cracking corrosion, leading to the breaking of the flexible pipe or cable.

It is already known, particularly from the French Pat. No. 1,426,113, the British Pat. No. 1,054,979 and the German Pat. No. 1,227,491, to use processes for improving the resistance of the metals to corrosion, wherein said metals are subjected to mechanical cold-working surface treatments, such as sand-blasting, shot-blasting, rolling or running between roller, embossing, hammering and polishing. The so-obtained improvement results from the compression of the metal (strain hardening) in the vicinity of its surface. However, the depth of the metal affected by these treatments remains small and is generally limited to 0.1 mm. (with an intense shot-blasting, a thickness of 0.2 mm can be reached).

This depth of treatment obtained by prior processes is insufficient, since the resistance to cracking corrosion thus obtained over a small thickness does not prevent the generalized corrosion of the metal. The latter progressively destroys the surface layer subjected to compression by the previous treatment and the sensitivity of the metal to cracking corrosion then reappears.

SUMMARY OF THE INVENTION

The main object of the invention is to achieve a protection of the metal against cracking corrosion over a substantially greater thickness than that achieved with the prior processes.

The process according to the invention whereby the resistance of an elongate element to cracking corrosion may be increased, is characterized in that at least the main faces of each portion of elongate element which have to be exposed to corrosion are subjected, before the putting in service of said element, to a series of flexions with successive inversions of the direction of curvature of the element. This series of flexions is adapted to generate, in the elongate element, compression zones having a thickness at least equal to one third of the distance separating the main faces from the longitudinal aixs of the elongate element.

According to a particularly advantageous embodiment of the invention, said series of flexions is effected by passing the elongate elements between rollers in staggered arrangement. When considering three successive rollers between which passes the elongate element, there will be selected the relation $0.02 \leqq (h/d) \leqq 0.30$ and advantageously $0.06 \leqq (h/d) \leqq 0.20$, h measuring the distance of the lowermost point of the intermediary roller from the plane tangent to the two other rollers at their uppermost points, and with $2d$ being the distance separating the centers of the two other rollers.

The invention also concerns the resulting products and particularly a metal elongate element resistant to cracking corrosion, wherein the internal stresses are so distributed that, in a direction perpendicular to the wall of said element or at least to one of the main walls corresponding to the greater size of the cross-section of said element, the metal comprises, in successive order, a zone in compressed state, a neutral zone, then a zone under tension, characterized in that said element has been pretreated by alternate flexions so that the thickness of the compression zone is at least equal to one third of the distance between the surface and the axis of the element.

The elongate element may optionally be straightened either by mere passage in the above-mentioned roller trains, or by passage through additional devices such as those described in the French Pat. No. 1,244,097 and No. 2,061,698, U.S. Pat. No. 3,269,007 and Swiss Pat. No. 98,121.

BRIEF DESCRIPTION OF THE DRAWINGS

Examples of embodiments of the invention are hereinafter described with reference to the accompanying drawings wherein.

DETAILED DISCUSSION OF THE INVENTION

Figure 2:
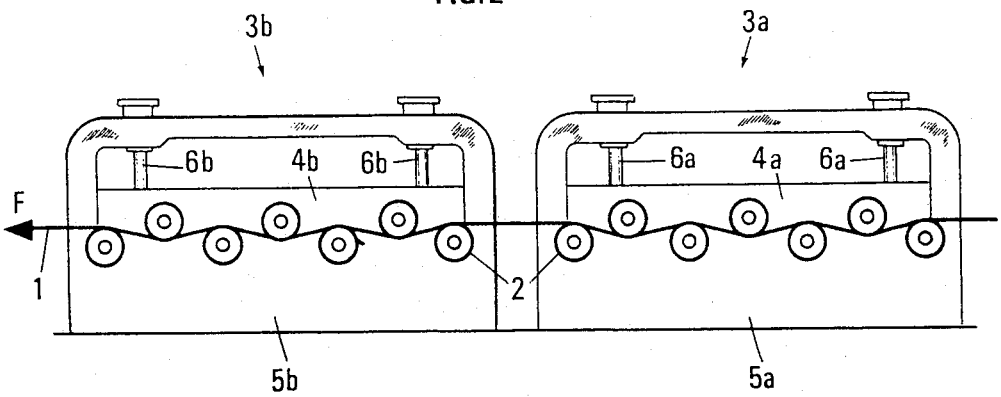
FIG. 2 shows a type of apparatus for effecting the treatment according to the invention.

As illustrated in FIG. 2, in the process according to the invention for increasing the resistance to cracking corrosion of an elongate element formed by cold drawing, element 1 is passed between rollers 2 in staggered arrangement.

FIG. 2 diagrammatically illustrates two successive roller trains respectively 3A and 3B.

In each roller train, the rollers 2 are carried by couples of frames (frames 4A, 5A and 4B, 5B). Jacks 6A and 6B are provided for bringing the frames 4A and 4B closer to frames 5A and 5B respectively.

Figure 2A:
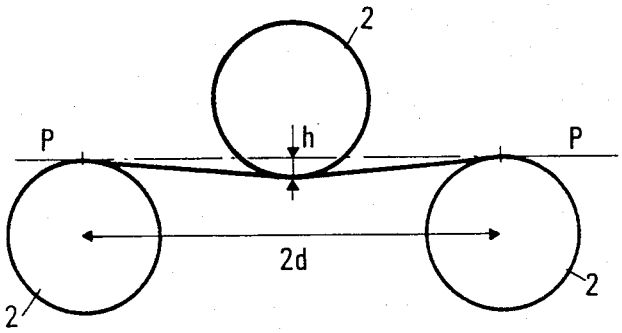
FIG. 2A is a diagram showing more precisely the conditions of operation of the present invention.

More particularly, the preliminary treatment according to the invention may be performed by passing the elongate element between rollers in staggered arrangement, such that, when considering three successive rollers, the condition: $0.02 \leqq (h/d) \leqq 0.30$, is fulfilled, h measuring the distance from the lowermost point of the intermediate roller to the plane P tangent to the two other rollers at their uppermost point, and **2*d*** being the distance separating the axes of these two other rollers (FIG. 2A).

Advantageously, the selected relationship will be:

$$0.06 \leqq (h/d) \leqq 0.20.$$

As shown in FIG. 2, it may be advantageous to make use, after the first train 3A of rollers in staggered arrangement for performing the treatment according to the invention, of a second roller train 3B, wherein the ratio h/d is generally smaller (for example of the order of 0.005 to 0.08), the train 3B then constituting a finishing train effecting a straightening of the wire, so that the wire will be substantially rectilinear at the output from said roller train.

In each roller train A and B, the ratio h/d may be substantially constant or may be so adjusted, for example, as to increase from the input to the output of the roller train, while remaining within the above-defined limits.

If necessary, several passages of element 1 through the roller trains will be effected, or more than two roller trains in series will be used.

The sensitivity to cracking corrosion of elongate metal elements is estimated as follows: the elongate element is placed so as to rest on two stationary bearing points, whereas a third bearing point, placed between the two first ones, may be progressively displaced to impart a curvature to the elongate element. The convex face of the so-curved element is then under tension. The tension is not actually measured: it suffices to mark the rise f taken by the elongate element. This rise is expressed in millimeters; the two extreme bearing points being for example at a distance of 100 mm.

The element being thus put under tension, it is immersed in a deaerated synthetic sea water prepared according to standard ASTM D 1141 and saturated with hydrogen sulfide. The operation is conducted at 16°-20° C. and the time t, expressed in hours, at the end of which the cracking occurs, is marked.

TEST No. 1

This test is effected with elements which have not been subjected to the treatment according to the invention (raw wires). These elements are flat steel wires whose cross-section is rectangular and of a size of 6×3 mm.

Figure 1:
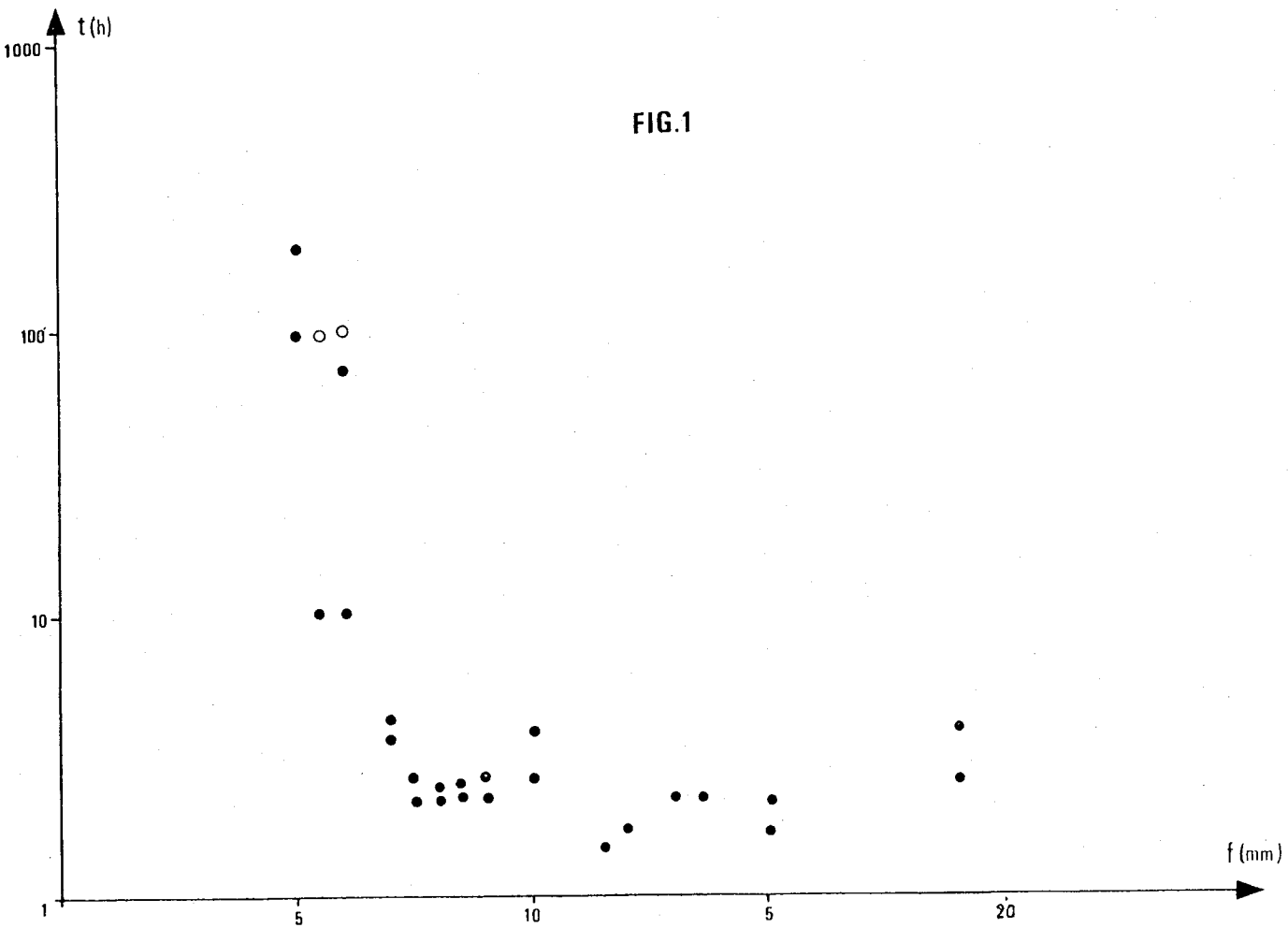
FIG. 1 illustrates the results of tests conducted without applying the process according to the invention.

FIG. 1 shows the obtained results: the black circles correspond to broken raw wires and the others to unbroken raw wires.

For rises greater than 7 mm the elements are cracked in a few hours. For lower rises, the left time rapidly increases and it is observed that, with rises of 5 mm, some elements are unbroken after 100 hours. An indefinite life time must correspond to rises slightly smaller than 5 mm. The concerned steel has a 0.78 carbon content and the following characteristics: breaking load: 1,485 MPa, elastic limit at 0.2%: 1,280 MPa. The rise of 5 mm corresponds substantially to 74% of the elastic limit. An indefinite life time would thus be obtained at about 70% of the elastic limit.

IMPROVEMENT IN THE RESISTANCE OF WIRES BY APPLICATION OF THE PROCESS ACCORDING TO THE INVENTION

TEST No. 2

Elongate elements 1 identical to those used in test No. 1, are passed through an apparatus adapted to subject them, during a continuous unreeling, to a series of flexions in opposite directions by making use of deformation and guiding elements 2 (rollers) in staggered arrangement, as shown in FIG. 2 (h/d = constant = 0.18 in the first roller train 3A and h/d varying from a value of 0.06 at the input to a value of 0.03 at the output of the second roller train 3B).

During this treatment, the elongate elements 1 are so arranged that their main faces, corresponding to the larger size of their cross-section, are in contact with rollers.

Figure 3:
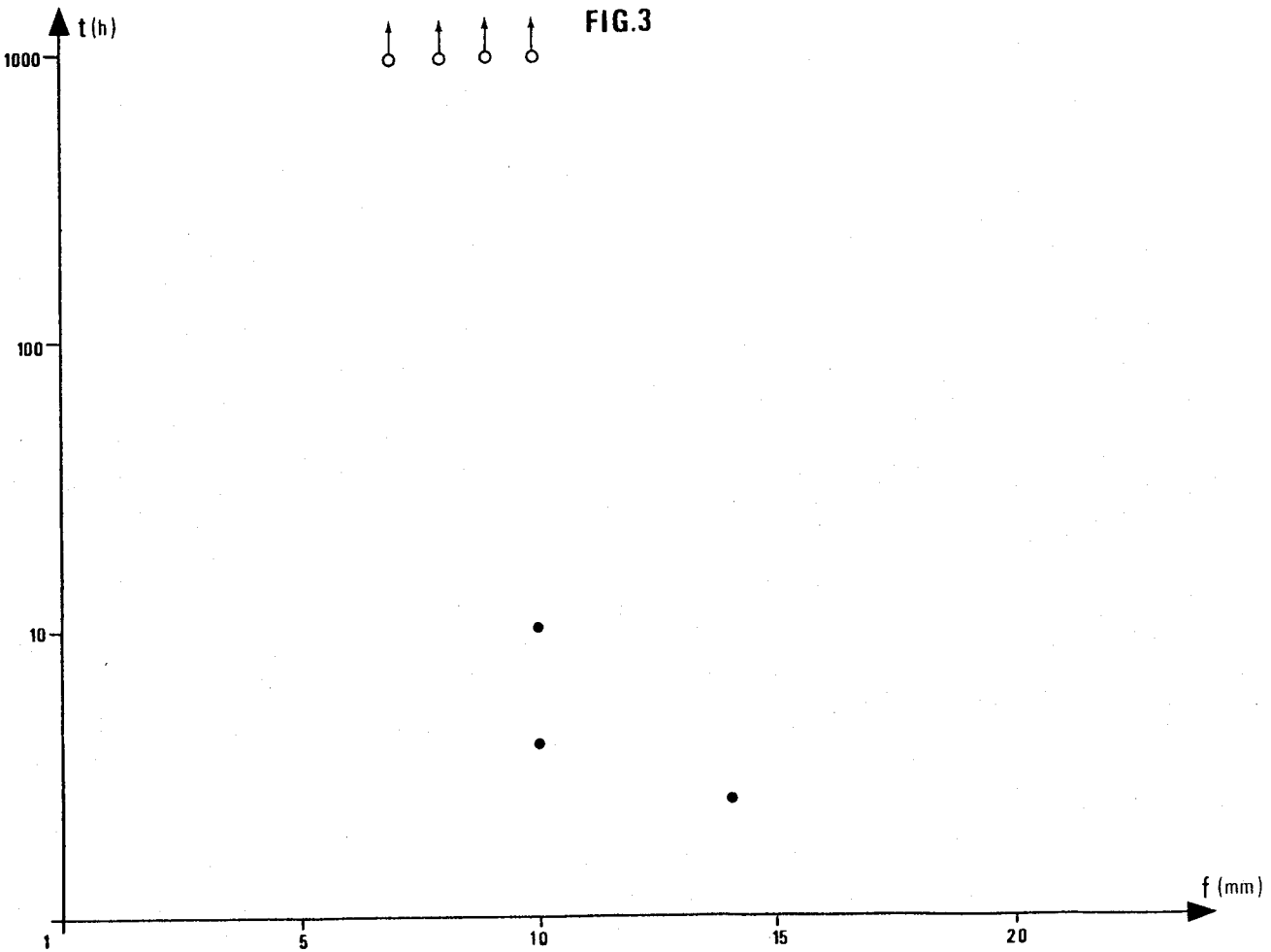
FIG. 3 illustrates the results obtained by application of this previous mechanical treatment, FIGS. 4 and 5 respectively show, by way of comparison, results obtained during another test with wires previously subjected to a treatment comprising alternate flexions of smaller amplitude and with wires subjected to a mere shot-blasting.

After this treatment, the resistance of the elongate elements is clearly increased as shown in FIG. 3 where the black circles show broken wires and the other circles unbroken wires.

An indefinite life time would be still maintained with rises of nearly 10 mm, which correspond to a strain substantially equal to 100% of the elastic limit.

TEST No. 3

Figure 4:
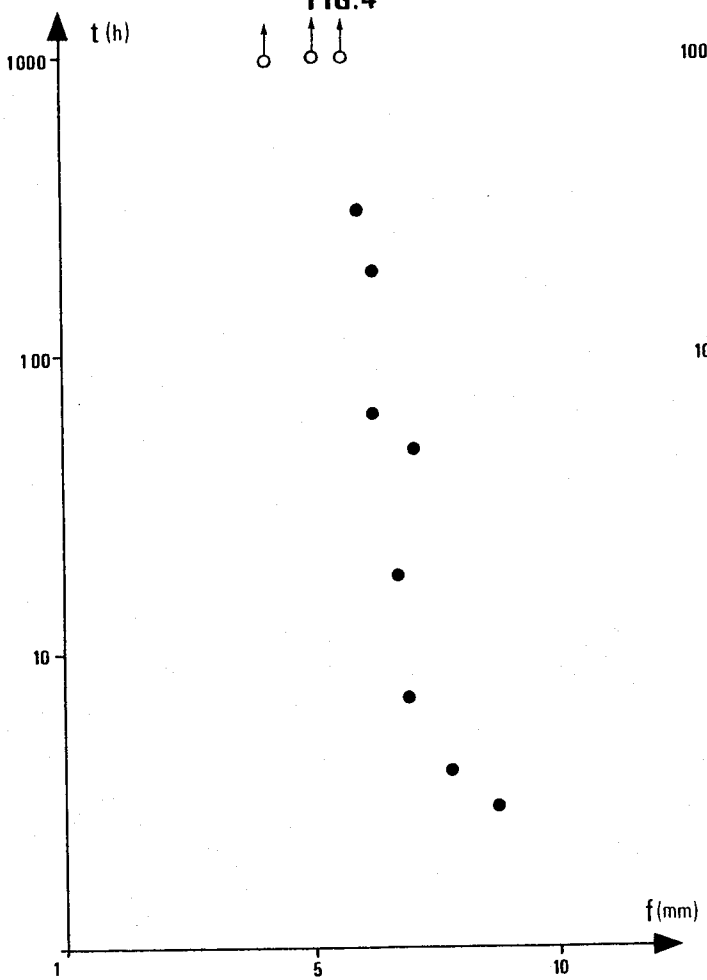

FIG. 4 gives the results obtained for an element identical to those used in tests No. 1 and No. 2, after passage through an apparatus such as described in test No. 2, but with a ratio h/d = 0.015 in the first train and h/d = 0.004 in the second train. A slight improvement with respect to test No. 1 is observed, an indefinite life time would be maintained for rises reaching 6 mm, hence much smaller than those reached in test No. 2.

TEST No. 4

Figure 5:
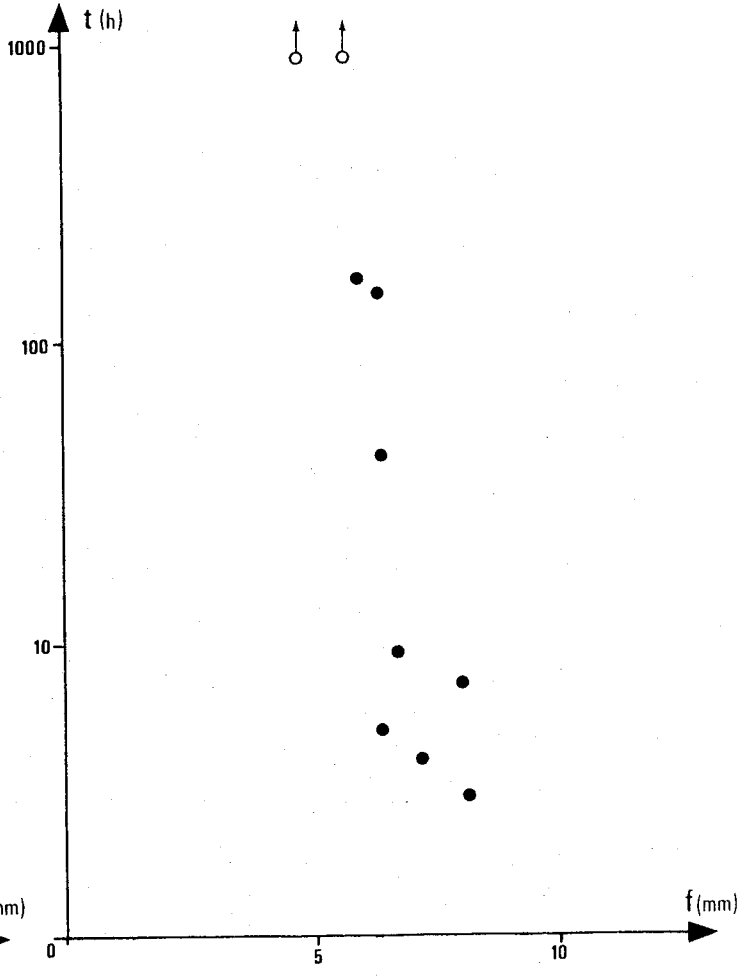

FIG. 5 gives the results obtained for an element identical to that of test No. 1 but previously subjected to a shot blasting of intensity 12 Almen A on each two main faces. A slight improvement is observed as compared to test No. 1, the indefinite life time would be maintained as in test No. 3 for rises reaching about 6 mm, hence much smaller than those achieved in test No. 2.

Figure 6:
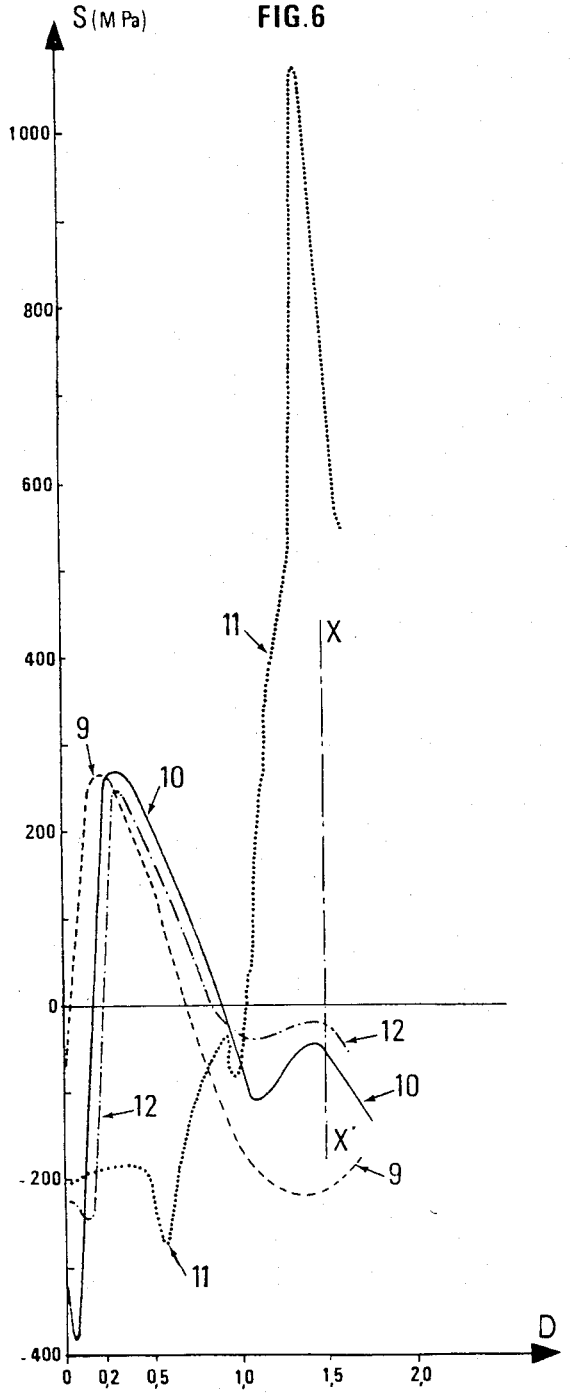
FIG. 6 shows, by way of comparison, the distribution of the stresses within the thickness of a raw wire and in the thickness of a wire previously subjected to various mechanical treatments.

FIG. 6 shows, by way of comparison, the distribution of the strains within the thickness of a raw wire, of a wire subjected to a mere shot blasting and in wire subjected to a treatment by alternate flexions.

A steel flat wire of 0.84% carbon content (having a cross-section of 6×3 mm) has been prepared by patentage (special hardening) of machine-made wire.

The stresses in the wire are determined in relation with the distance to the surface of the wire, the value S of the measured stress being expressed in Megapascal and plotted as ordinate on the graph (positive value for a tension stress and negative value for a compression stress) the abscissa D representing the depth in the metal (in mm) counted from the wire surface towards its longitudinal symmetry axis X'X.

The method used for determining the sresses in the wire was the so-called "rise" method or "curvature method", well-known in the art of the metallurgy and described for example, in No. 31 of September 1977, pages 12 and following of the quarterly bulletin "Les Mémoires techniques du C.E.T.I.M." published by "le Centre Technique des Industries Mécaniques".

The curve 9 of FIG. 6 shows that in a raw wire, the surface layer is under tension whereas the compression stresses are found near the wire axis.

This same wire is subjected to a shot blasting of intensity 12 Almen A on its two main faces. FIG. 6 (curve 10) shows that the compression stresses have been induced into the metal up to a depth of 0.2 mm from its external surface.

A mechanical treatment by alternate flexions according to the invention has also be performed with another sample of the same wire by passing it through two trains of seven rollers in staggered arrangement, the ratio h/d in the first train being constant and equal to 0.18 and varying in the second train from 0.06 at the input to 0.03 at the output. The rollers have a 52 cm diameter; h measures the distance between the lowermost point of the intermediate roller and the plane tangent to the other rollers at their uppermost point, and 2d is the distance separating the centers of these two other rollers.

The curve 11 of FIG. 6 shows that the treatment according to the invention resulted in the production of compression stresses within the metal over a thickness of almost 1.1 mm from each face of said flat wire of 3 mm of thickness i.e., in a zone amounting to more than $\frac{2}{3}$ of the wire thickness, the traction stresses being transferred to the middle, in the immediate vicinity of the symmetry axis X'X.

The wire thus treated according to the invention exhibits a high resistance to cracking corrosion.

Another sample of the same wire was subjected to a mechanical treatment by alternate flexions outside the above-defined limit values of h/d. The ratio h/d in the first roller train has been set to 0.015 and in the second roller train to 0.004. The curve 12 of FIG. 6 shows that this treatment did not provide for compression strains over a thickness of more than 0.2 mm in this flat wire of 3 mm thickness.

What is claimed is:

1. A process for increasing the resistance of an elongate element to cracking corrosion comprising subjecting at least the main faces of each portion of the elongate element to be exposed to corrosion, before putting the elongate element into service, to a series of successive flexions and inversions of the direction of curvature of the elongate element in a manner such that compression zones having a thickness at least equal to one third of the distance separating the faces from the longitudinal axis of the elongate element are generated, and said series of flexions and inversions being generated by passing the elongate element at least through a first train of rollers in a staggered configuration such that, in an arrangement of three rollers where two of the rollers are located at a position lower than a center roller, the following conditions are met:

$$0.02 \leqq (h/d) \leqq 0.30$$

wherein h is the distance between the lowermost point of the center roller from the plane tangent to the two lower rollers at their uppermost point, and 2d is the distance separating the centers of the lower two rollers.

2. A process according to claim 1 wherein the elongate element is passed through two roller trains, the ratio h/d of the first roller train being constant, and the ratio h/d in the second roller train increasing from the input from the output of the roller train.

3. A process according to claim 2 wherein the ratio h/d in the first roller train is equal to about 0.18, and varies downwardly in the second roller train from 0.06 at the input to 0.03 at the output.

4. A process according to claim 1 wherein elongate element treated is a flat steel wire.

5. A process according to claim 4 wherein the flat steel wire is made of high carbon steel.

6. A process according to claim 5 wherein the cross-section of the steel wire is rectangular and of a size of 6×3 mm.

7. A process according to claim 1, wherein the ratio h/d is equal to 0.06–0.20.

8. A process according to claim 1, wherein the elongate element is passed successively through said first train of rollers in staggered arrangement, then through at least one second train of rollers in staggered arrangement wherein the ratio h/d is smaller than the ratio h/d of the first roller train.

9. A process according to claim 8, wherein the elongate element is passed through a second roller train wherein the ratio comprises between 0.005 and 0.08.

10. A process according to claim 1, wherein the elongate element is passed through at least one roller train wherein the ratio h/d is substantially constant.

11. A process according to claim 1, wherein the elongate element is passed through at least one roller train wherein the ratio h/d increases from the input to the output of the roller train.

12. A metal elongate element having increased resistance to cracking corrosion by having been treated by the process of claim 10, the treatment resulting in a metal elongate element having a distribution of internal stresses such that in a direction perpendicular to the surface of the element, or at least to the main surfaces corresponding to the larger size of cross-section of the element, the metal comprises, in successive order, a zone of compressed state at least equal to one third the distance between the surface and the axis of the element, a neutral zone, and a zone under tension.

13. A metal elongate element according to claim 12 wherein the element is a flat steel wire.

14. A metal elongate element according to claim 13 wherein the element is made of high carbon steel.

15. A metal elongate element according to claim 14 wherein the cross-section of the steel wire is rectangular and of a size of 6×3 mm.

16. A metal elongate element resistant to cracking corrosion, wherein the distribution of the internal stresses is such that, in a direction perpendicular to the surface of said element, or at least to the main surfaces corresponding to the larger size of the cross-section of said element, the metal comprises, in successive order, a zone of compressed state, a neutral zone and a zone under tension, said compression zone having been produced in said element by pretreatment by alternately flexing of the element in a manner such that the thickness of the compression zone produced is at least equal to one third of the distance between the suface and the axis of the element, and said flexing having been effected by passing the elongate element at least through a first train of rollers arranged in a staggered configuration such that in an arrangement of three rollers two of the rollers are located at a position lower than a center roller, and wherein the following conditions were met:

$$0.2 \leqq (h/d) \leqq 0.30$$

wherein h was the distance between the lowermost point of the center roller from the plane tangent to the lower two rollers at their uppermost point, and 2d is the distance separating the centers of the lower two rollers.

17. A metal elongate element according to claim 16 wherein said elongate element has an increased resistance to cracking corrosion as a result of said treatment having been conducted wherein the ratio h/d was equal to 0.06–0.20.

18. A metal elongate element according to claim 17 wherein the elongate element was passed successively through a first set of rollers in staggered arrangement with an h/d ratio of 0.06–0.20, and then through a second roller train wherein the ratio h/d was equal to 0.005–0.08.

19. A metal elongate element according to claim 16 wherein the element is a flat steel wire.

20. A metal elongate element according to claim 19 wherein the steel is high carbon steel.

* * * * *

UNITED STATES PATENT AND TRADEMARK OFFICE

CERTIFICATE OF CORRECTION

PATENT NO. : 4,489,137

DATED : December 18, 1984

INVENTOR(S) : BERNARD LE BOUCHER ET AL

It is certified that error appears in the above-identified patent and that said Letters Patent is hereby corrected as shown below:

Column 7, line 15: reads "$0.2 \leqq (h/d) \leqq 0.30$"

Should read -- $0.02 \leqq (h/d) \leqq 0.30$ --

Signed and Sealed this

*Twentieth* Day of *August 1985*

[SEAL]

*Attest:*

DONALD J. QUIGG

*Attesting Officer* *Acting Commissioner of Patents and Trademarks*